US009151576B2

(12) United States Patent
Van Elburg et al.

(10) Patent No.: US 9,151,576 B2
(45) Date of Patent: Oct. 6, 2015

(54) BALLISTIC RESISTANT ARTICLE

(75) Inventors: Johann Van Elburg, Landgraaf (NL); Ralph Schielen, Landgraaf (NL); Roelof Marissen, Born (NL); Harm Van Der Werff, Bunde (NL)

(73) Assignee: DSM IP ASSETS B.V., Heerlen (NL)

( * ) Notice: Subject to any disclaimer, the term of this patent is extended or adjusted under 35 U.S.C. 154(b) by 0 days.

(21) Appl. No.: 13/812,943

(22) PCT Filed: Jul. 28, 2011

(86) PCT No.: PCT/EP2011/062978
§ 371 (c)(1),
(2), (4) Date: Apr. 8, 2013

(87) PCT Pub. No.: WO2012/013738
PCT Pub. Date: Feb. 2, 2012

(65) Prior Publication Data

US 2013/0220106 A1 Aug. 29, 2013

(30) Foreign Application Priority Data

Jul. 29, 2010 (EP) ..... 10171269

(51) Int. Cl.
*F41H 5/00* (2006.01)
*F41H 5/04* (2006.01)
*F41H 5/013* (2006.01)

(52) U.S. Cl.
CPC ..... *F41H 5/0478* (2013.01); *F41H 5/013* (2013.01); *F41H 5/0485* (2013.01); *Y10T 29/49732* (2015.01)

(58) Field of Classification Search
None
See application file for complete search history.

(56) References Cited

U.S. PATENT DOCUMENTS 5,306,557 A * 4/1994 Madison ..... 428/304.4
2001/0053645 A1 12/2001 Henderson
2012/0085224 A1* 4/2012 Jongedijk et al. ..... 89/36.02

FOREIGN PATENT DOCUMENTS

DE 198 32 255 1/2000

OTHER PUBLICATIONS

International Search Report for PCT/EP2011/062978, mailed Oct. 18, 2011.

* cited by examiner

*Primary Examiner* — Reginald Tillman, Jr.
(74) *Attorney, Agent, or Firm* — Nixon & Vanderhye P.C.

(57) ABSTRACT

The invention relates to an armor comprising in front to back order at least one rigid first panel comprising inorganic fibers and at least one second panel comprising polymeric fibers, characterized in that the at least one rigid first panel has a flexural strength of at least 300 MPa and the at least one second panel has a flexural strength of at most 250 MPa.

19 Claims, No Drawings

BALLISTIC RESISTANT ARTICLE

This application is the U.S. national phase of International Application No. PCT/EP2011/062978, filed 28 Jul. 2011, which designated the U.S. and claims priority to EP Application No. 10171269.3, filed 29 Jul. 2010, the entire contents of each of which are hereby incorporated by reference.

The present invention relates generally to the field of armors, especially rigid armors. More particularly the present invention relates to an armor comprising in front to back order at least one rigid first panel comprising inorganic fibers and at least one second panel comprising polymeric fibers. The invention also relates to a system containing this armor, e.g. vehicles, crafts and buildings.

One way of protecting an object from a projectile is equipping that object with an armor. The armors vary in shape and size to fit the object to be protected and may be constructed from various materials e.g. metals, ceramics, glass, polymeric and inorganic fibers and combination thereof. In particular inorganic materials such as carbon fibers, ballistic glass and glass fibers are relatively lighter in weight in comparison with steel; are resistant to heat, abrasion and compression; and have high chemical stability. Such materials have gained popularity in time because of their useful properties.

An example of an armor is given in EP 1 099 089 B1. Therein it is disclosed a light armoring element suitable for security vehicles having a number of frontal layers comprising high strength fibers and a larger number of backing layers of high elasticity. As a specific embodiment, an armoring element is disclosed comprising frontal layers of carbon fiber fabrics said frontal layers having an areal density of about 200 $g/m^2$ and backing layers of aramid fiber fabrics, said backing layers having an areal density of about 90 $g/m^2$.

A further example of an armor is given in EP 2 047 975 A1. Therein an armor is disclosed, which comprises a rigid strike face from e.g. glass basalt fibers or glass fibers and a back face comprising inter alia polymeric tapes.

It was observed that the known armors containing both polymeric and inorganic fibers such as the armors of EP 1 099 089 B1 and EP 2 047 975 A1, are usually poorly designed by compromising part of their ballistic resistance in the interest of a lower areal density. Generally the areal density of an armor is related to the weight of the armor, a lower areal density usually implying a lighter armor.

It was also observed that known armors are designed either to be thick and rigid in order to mitigate larger threats but at the expense of their weight, either less thick and possibly flexible to achieve lower weights, but at the expense of their ballistic performance. Such compromises and rationales prove that there is until now little understanding of the various factors influencing the efficiency of known armors.

There is therefore a need for producing efficient armors comprising both inorganic and polymeric fibers, which compromise little in terms of their capability of defeating projectiles posing various levels of threats. There is also a need for such armors which can defeat high velocity projectiles, i.e. projectiles traveling with a velocity of least 1100 m/s. There is also a need to provide an armor, which is versatile and easy to construct.

An object of the present invention may thus be to obviate or mitigate at least the above-recited disadvantage of the known armors.

The present invention provides an armor comprising in front to back order at least one rigid first panel comprising inorganic fibers and at least one second panel comprising polymeric fibers, characterized in that the at least one rigid first panel has a first flexural strength and the second panel has a second flexural strength and wherein the first flexural strength is higher than the second flexural strength.

The present invention also provides an armor comprising in front to back order at least one rigid first panel comprising inorganic fibers and at least one second panel comprising polymeric fibers, characterized in that the at least one rigid first panel has a flexural strength of at least 300 MPa and the at least one second panel has a flexural strength of at most 250 MPa.

It was observed that the armor of the invention shows good ballistic performance and survivability. A further advantage of the armor of the invention may be its multi-hit capability and/or its reduced back face deformation. It was also observed that the armor of the invention is easy to construct.

In particular, it was observed that the at least one rigid first panel synergistically interacts with the at least one second panel to improve the ballistic performance of the armor of the invention over known armors comprising both inorganic and polymeric fibers.

It was also observed that by combining at least one rigid first panel as defined hereinabove and after with at least one second panel as defined hereinabove and after, the two types of panel may synergistically interact with each other to improve also other various properties of the inventive armor.

By fiber is herein understood an elongated body having a length, a width and a thickness, the length dimension of which is much greater that its transverse dimensions of width and thickness. The term fiber also includes various embodiments e.g. a filament, a ribbon, a strip, a band, a tape and the like having regular or irregular cross-sections. The fibers may have continuous lengths, known in the art as filaments, or discontinuous lengths, known in the art as staple fibers. Staple fibers are commonly obtained by cutting or stretch-breaking filaments. The fibers may have various cross-sections, e.g. regular or irregular cross-sections with a circular or rectangular shape. A yarn for the purpose of the invention is an elongated body containing many fibers.

In the following discussion, it is considered that an incoming projectile has an expected trajectory relative to the armor, e.g. perpendicular or at an angle in respect thereof. The trajectory establishes a direction for understanding certain terms used hereinbefore and after. By front and back panels is herein understood that the panels making the inventive armor would successively confront the projectile as it approaches and impacts said armor.

The armor of the invention also referred to herein as the inventive armor, comprises a rigid first panel, i.e. a first panel having a flexural strength of at least 300 MPa. Preferably the flexural strength of said rigid first panel is at least 400 MPa, more preferably at least 500 MPa, even more preferably at least 600 MPa, most preferably of at least 700 MPa. Preferably, the flexural strength of the rigid first panel is between 300 and 800 MPa, more preferably between 450 and 775 MPa, most preferably between 570 and 750 MPa. It was observed that by using such rigid first panels the ballistic performance of the inventive armor is improved.

The at least one rigid first panel is preferably the outermost front panel with respect to the body to be protected by the inventive armor. It was observed that said panel is able to deform the incoming projectile making it easier to be stopped by the armor. Preferably, the rigid first panel has a size adapted to cover a surface of the object, thing of body to be protected in its entirety.

The rigid first panel used in accordance with the invention comprises inorganic fibers. Good results are obtained when the inorganic fibers contained by said rigid first panel are chosen from the group consisting of glass fibers, ceramic fibers, carbon fibers, basalt fibers, glass-basalt fibers and combinations thereof. In particular the use of rigid first panels containing glass fibers in the inventive armor proved most advantageous.

The rigid first panel used in accordance with the invention preferably also comprises a binder. The purpose of the binder is to fixate the fibers in the panel and it may advantageously contribute to the mechanical properties thereof. Various binders may be used together with the inorganic fibers to manufacture the rigid first panels used in the present invention, examples thereof including thermosetting and thermoplastic binders.

A wide variety of thermosetting materials are available, however, epoxy resins, phenolic resins and polyester resins are most preferred largely due to their ease of manipulation. Other thermosetting binders include melamine based resins, vinyl esters, unsaturated polyesters and epoxides.

Thermoplastic binders include polyurethanes, polyvinyls, polyacrylics, polybutyleneterephthalate (PBT), polyolefins, polyamides, polycarbonates or thermoplastic elastomeric block copolymers such as polyisopropene-polyethylene-butylene-polystyrene or polystyrene-polyisoprene-polystyrene block copolymers. Other suitable thermosetting and thermoplastic binders are enumerated in, for example, WO 91/12136 A1 (pages 15-21) included herein by reference.

Good results in terms of ballistic performance of the inventive armor were obtained when the binder used in the manufacturing of rigid first panels had a tensile modulus of at least 0.5 GPa, more preferably of at least 1 GPa, most preferably of at least 1.5 GPa. Preferred example of binders with such tensile modulus include epoxy resins, phenolic resins, polyester, polycarbonate (PC), vinylester, melamineformaldehide, polyamid (PA), polyethyleneterephtalate (PET), polybuthyleneterephtalate, styrene-acrylonitril (SAN), acrylonitril-butadiene-styreen (ABS), polysulphone, polystyrene, polyetherimide (PEI), polyimide (PI), polyphenylene sulfide (PPS), polyphenylene oxide (PPO). More preferred examples of binders with such tensile modulus are those selected out of the group consisting of epoxy resins, phenolic resins, polyester, vinylester, melamineformaldehide, polyamides, PET, PBT, PC and PEI. Most preferred binders are epoxy resins, phenolic resins and PC. Inventive armors with rigid first panels containing such binders had improved ballistic performance as it was observed that the impacts were effectively mitigated by said armors.

The inorganic fibers contained by the rigid first panel form an assembly of fibers, preferred configurations of said assembly including a fabric of a woven or unwoven inorganic fibers. Preferably the rigid first panel comprises a plurality of layers stacked upon each other, said layers containing a woven or a non-woven fabric made from the inorganic fibers. Various woven fabric configurations may be used, preferred ones including plain weaves and basket weaves. Non-woven fabric may include felts, i.e. fabrics containing randomly oriented fibers, or fabrics wherein a majority of the inorganic fibers, i.e. at least 70 mass %, preferably at least 90 mass %, more preferably about 100 mass % from the total mass of the inorganic fibers contained by the fabric, run along a common direction. Such fabrics are also known as unidirectional non-woven fabric. When a plurality of layers containing unidirectional non-woven fabrics are used for manufacturing the rigid first panel, preferably the adjacent layers are rotated in respect of each other such that the running direction of fibers in a fabric of a layer is under an angle, preferably about 90°, with the running direction of fibers in the fabric of the adjacent layer.

Manufacturing rigid panels containing inorganic fibers is well known in the art. Processes for making such rigid panels include pultrusion, resin transfer moulding, autoclave moulding and compression molding. Pultrusion is a process of manufacturing rigid panels containing an assembly of fibers whereby the fibers are pulled through a binder, e.g. a thermosetting or thermoplastic material, optionally followed by a separate preforming step. When a thermosetting material is used as binder, the pultruded panel is introduced into a heated die where said binder undergoes polymerization, subsequently followed by cooling the panel to form a rigid panel. When a thermoplastic material is used as the binder, the panel is made by either impregnating the assembly of fibers or surrounding said assembly with a sheet of the thermoplastic material which is then molten up. Consolidation of the panel into a rigid panel may be performed by cooling the panel after melting of the thermoplastic material. In case the panel is also compressed, preferably cooling is performed while maintaining pressure. For example an assembly of inorganic fibers impregnated with a binder may be compressed under pressure, e.g. of between 10 and 70 bars, and temperature, to consolidate the assembly of inorganic fibers into a rigid panel. Another process for manufacturing a rigid panel may include injecting a binder into an assembly of fibers and consolidating the binder-containing assembly for example by resin transfer moulding or compression moulding. Such processes are well known in the art, e.g. from WO 2008/010823 A2 included herein in its entirety by reference.

Preferred inorganic fibers for use in accordance with the invention are carbon fibers or graphite fibers. Carbon fibers having various properties can be acquired from R&G GmbH, Toray Industries, Toho Tenax, Mitsubushi Rayon and Hexcel. Preferred carbon fibers are polyacylonitrile (PAN) based carbon fibers, pitch-based carbon fibers, mesophase pitch-based carbon fibers, isotropic pitch-based carbon fibers, rayon-based carbon fibers, gas-phase-grown carbon fibers. By carbon fiber is herein understood a fiber containing at least 90% carbon and preferably obtained by the controlled pyrolysis of appropriate fibers. By graphite fiber is used to describe fibers that have carbon in excess of 99%. Large varieties of appropriate fibers are used as precursors to produce carbon fibers of different morphologies and different mechanical properties. The most prevalent precursors are PAN, cellulosic fibers (viscose rayon, cotton), petroleum or coal tar pitch and phenolic fibers.

Most preferred inorganic fibers for use in accordance with the invention are glass fibers. Preferred glass fibers are those commonly known as A-glass, C-glass, D-glass, E-glass, ECR-glass, AR-glass, R-glass, more preferably 901-S glass fibers (from Owens Corning Fiberglass), S-2 glass fibers or glass fibers known under the trademark HiPer-Tex™ (from 3B or Owen Cornings). E-glass is a glass material that has lower alkali content than ordinary "window" glass and has good tensile and compressive strength and stiffness. E-glass is available in fiber form for example from AGY. R-glass and S-glass are similar to E-glass but have higher tensile strength and modulus. R-glass is available for example from OCV Reinforcements, and S-glass is available from for example from AGY. The glass fibers may be coated with a coating before being used to manufacture the rigid first panel. For example in case of glass fibers which are to be bonded to an epoxy resin, the glass fibers are preferably coated with a coating comprising a propylsilane coupling agents, preferably with an excess of diglycidlether of bisphenyl. A description concerning the mechanical and physical properties of inorganic fibers and more in particular of glass fibers as well as methods for the manufacture thereof can be found in Ullmann's Encyclopedia of Industrial Chemistry, Release 2010, 7th Edition, Chapter "*Fibers, 5. Synthetic Inorganic*" and in particular subchapters 1.2, 1.3 and 2. This entire description and in particular the description in the mentioned subchapters are included herein by reference.

The diameter of the inorganic fiber used in accordance with the invention is preferably at least 1 μm, more preferably at least 3 μm, most preferably at least 5 μm. Said diameter is preferably at most 25 μm, more preferably at most 20 μm, most preferably at most 15 μm. Said diameter can be routinely measured with a commercially available optical microscope. Preferably, the inorganic fibers having a diameter within the above mentioned ranges are glass fibers. If carbon fibers are used preferably said carbon fibers have a diameter between 1 and 15 μm, more preferably between 5 and 10 μm.

Preferably, the inorganic fibers have a tensile strength of at least 1.5 GPa, more preferably of at least 2.0 GPa, even more preferably of at least 2.5 GPa, most preferably of at least 3.0 GPa. Preferably, the inorganic fibers have a tensile modulus (also referred to as modulus of elasticity) of at least 30 GPa, more preferably at least 50 GPa, even more preferably at least 65 GPa, most preferably at least 80 GPa. Preferably, the inorganic fibers having the above mentioned tensile properties within the above mentioned ranges are glass fibers, more preferably S2-glass fibers. If carbon fibers are used, preferably said carbon fibers have a tensile strength of at least 3.5 GPa, more preferably of at least 4 GPa, most preferably of at least 4.5 GPa. The tensile modulus of the carbon fibers is preferably at least 150 GPa, more preferably at least 190 GPa, most preferably at least 230 GPa.

Rigid first panels with increased flexural strength may be obtained by increasing the amount of inorganic fibers in the panel. An even larger increase in the flexural strength of the first rigid panels is obtained when the inorganic fibers are glass fibers and more in particular S2-glass fibers. Preferably, the inorganic fibers and more preferably the glass fibers are in an amount of at least 50 vol % of the total volume of the panel, more preferably of at least 60 vol %, most preferably of at least 70 vol %. Preferably, the inorganic fibers and more preferably the glass fibers are in an amount of between 50 and 85 vol % of the total volume of the panel, more preferably of between 60 and 80 vol %, most preferably of between 65 and 75 vol %. For example, amounts of glass fibers of between 65 and 75 vol % of the total volume of the panel may lead to rigid first panels having a flexural strength of higher than 600 MPa. Preferably, the volume of fibers used in the rigid first panel consists of inorganic fibers or in other words, the only inorganic fibers are used to manufacture said rigid first panel.

The remaining vol % in the first rigid panel may be due to the presence of a binder, various coatings and other additives commonly used in the manufacturing of such panels. Good results were obtained when the amount of binder in the panel was at most 50 vol % of the total volume of the panel, more preferably at most 40 vol %, most preferably at most 30 vol %. Preferably the binder vol % adds to the inorganic fibers' vol % to yield about 100%.

The armor of the invention may comprise one or more rigid first panels. In case a plurality of rigid first panels is used, preferably the adjacent panels are attached to each other over at least part of their adjacent surfaces. The said adjacent panels may be attached to each other using spots or layers of an adhesive material or they may be mechanically attached with e.g. bolts, staples and the like. The inventive article however preferably contains only one rigid first panel. Such an inventive article with only one rigid first panel proved to be easy to manufacture and install while having a good ballistic performance.

The inventive armor can also be considered as having a strike face component and a back face component. Preferably, the at least one rigid first panel forms the strike face component of the inventive armor. By "strike face component" is herein understood the component of the inventive armor positioned to receive a ballistic impact, e.g. the impact of a projectile such as a bullet, prior to the back-face component. The strike face component is positioned between the threat and the thing or body to be protected by the threat. In a preferred embodiment, the strike face component is the component that receives first the impact of the projectile. This may be the case when the inventive armor is positioned in front of any eventual additional armors, e.g. armored vehicle hulls, building walls, etc.

The inventive armor also comprises at least one second panel containing polymeric fibers and having a flexural strength of at most 250 MPa.

Preferably, the polymeric fibers contained by the second panel are in an amount of at least 50 mass % of the total mass of the panel, more preferably of at least 70 mass %, most preferably of at least 90 mass %. Preferably, the mass of fibers used in the second panel consists of polymeric fibers, i.e. the fibers used to manufacture said second panel are only polymeric fibers.

The second panel contains polymeric fibers. Examples of polymeric fibers include but are not limited to fibers manufactured from polyamides and polyaramides, e.g. poly(p-phenyleneterephthalamide) (known as Kevlar®); poly(tetrafluoroethylene) (PTFE); poly{2,6-diimidazo-[4,5b-4',5'e] pyridinylene-1,4(2,5-dihydroxy)phenylene} (known as M5); poly(p-phenylene-2,6-benzobisoxazole) (PBO) (known as Zylon®); poly(hexamethyleneadipamide) (known as nylon 6,6), poly(4-aminobutyric acid) (known as nylon 6); polyesters, e.g. poly(ethylene terephthalate), poly(butyleneterephthalate), and poly(1,4 cyclohexylidenedimethyleneterephthalate); polyvinyl alcohols; thermotropic liquid crystal polymers (LCP) as known from e.g. U.S. Pat. No. 4,384,016; but also polyolefins e.g. homopolymers and copolymers of polyethylene and/or polypropylene. Also combinations of polymeric fibers manufactured from the above referred polymers can be used to manufacture the second panels. Preferred fibers are polyolefin fibers, polyamide fibers and LCP fibers.

Good results were obtained when the polymeric fibers are polyolefin fibers, more preferably polyethylene fibers. Preferred polyethylene fibers are ultrahigh molecular weight polyethylene (UHMWPE) fibers. Polyethylene fibers may be manufactured by any technique known in the art, preferably by a melt or a gel spinning process. Most preferred fibers are gel spun UHMWPE fibers, e.g. those sold by DSM Dyneema, NL under the name Dyneema®. If a melt spinning process is used, the polyethylene starting material used for manufacturing thereof preferably has a weight-average molecular weight between 20,000 and 600,000 g/mol, more preferably between 60,000 and 200,000 g/mol. An example of a melt spinning process is disclosed in EP 1,350,868 incorporated herein by reference. If the gel spinning process is used to manufacture said fibers, preferably an UHMWPE is used with an intrinsic viscosity (IV) of preferably at least 3 dl/g, more preferably at least 4 dl/g, most preferably at least 5 dl/g. Preferably the IV is at most 40 dl/g, more preferably at most 25 dl/g, more preferably at most 15 dl/g. Preferably, the UHMWPE has less than 1 side chain per 100 C atoms, more preferably less than 1 side chain per 300 C atoms. Preferably the UHMWPE fibers are manufactured according to a gel spinning process as described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "*Advanced Fibre Spinning Technology*", Ed. T. Nakajima, Woodhead Publ. Ltd (1994), ISBN 185573 182 7.

In a special embodiment of the present invention, the polymeric fiber is a polymeric tape. The tape is preferably manufactured from polyolefin, more preferably from UHMWPE. A polymeric tape (or a flat tape) for the purposes of the present invention is a polymeric fiber with the cross sectional aspect ratio of preferably at least 5:1, more preferably at least 20:1, even more preferably at least 100:1 and yet even more preferably at least 1000:1. The width of the polymeric tape is preferably between 1 mm and 600 mm, more preferable between 10 mm and 400 mm, even more preferably between 30 mm and 300 mm, yet even more preferably between 50 mm and 200 mm and most preferably between 70 mm and 150 mm. Thickness of the polymeric tape preferably is between 1 μm and 200 μm and more preferably between 5 μm and 100 μm.

The tensile strength of the polymeric fibers is preferably at least 1.2 GPa, more preferably at least 2.5 GPa, most preferably at least 3.5 GPa. The tensile modulus of the polymeric fibers is preferably at least 30 GPa, more preferably at least 50 GPa, most preferably at least 60 GPa. Best results were obtained when the polymeric fibers were UHMWPE fibers having a tensile strength of at least 2 GPa, more preferably at least 3 GPa and a tensile modulus of at least 40 GPa, more preferably of at least 60 GPa, most preferably at least 80 GPa.

Preferably, the at least one second panel containing polymeric fibers has a flexural strength of at most 200 MPa, more preferably of at most 150 MPa, most preferably of at most 110 MPa. Preferably said at least one second panel has a flexural strength of at least 10 MPa, more preferably of at least 20 MPa, even more preferably at least 30 MPa, most preferably at least 50 MPa. When aramid fibers are used to manufacture the at least one second panel, said panel preferably has a flexural strength of between 50 and 250 MPa, more preferably between 100 and 200 MPa, most preferably between 150 and 200 MPa. When polyolefin fibers and more in particular UHMWPE fibers are used to manufacture the at least one second panel, said panel preferably has a flexural strength of between 10 and 150 MPa, more preferably between 20 and 130 MPa, most preferably between 30 and 110 MPa. It was observed that using second panels having a flexural strength within the above preferred values, an efficient inventive armor having also good ballistic performance and low back face deformation was obtained.

The second panel used in the inventive armor may also contain a matrix material, which may be locally applied to bond together and stabilize the polymeric fibers. Suitable matrix materials are described in e.g. EP 0191306 B1, EP 1170925 A1, EP 0683374 B1 and EP 1144740 A1 included herein by reference. The matrix material may be applied in various forms and ways; for example as a bonding strip, by at least partially coating the fibers, or in the form of a film or a carrier film. Best results in terms of ballistic resistance of the inventive armor were obtained when the matrix material used in the manufacturing of second panels had a tensile modulus of at most 0.5 GPa, more preferably of at most 0.4 GPa, most preferably of at most 0.3 GPa. Preferred example of matrix materials having the preferred tensile modulus are polyurethanes, polyvinyls, polyacrylics, polybutyleneterephthalate (PBT), polyolefins, polyamides, polycarbonates or thermoplastic elastomeric block copolymers such as polyisopropene-polyethylene-butylene-polystyrene or polystyrene-polyisoprene-polystyrene block copolymers (e.g. Prinlin®).

The amount of matrix contained by the at least one second panel is preferably at most 30 mass % of the total mass of said second panel, most preferably at most 20 mass %, most preferably at most 10 mass %. In a preferred embodiment the at least one second panel used to manufacture the inventive armor contains is binder- or matrix-free. It was observed that such binder or matrix free panels provide the inventive armor with improved ballistic performance.

In an embodiment of the invention, the at least one second panel contains an assembly of polymeric fibers. Preferably, the assembly of polymeric fibers comprises randomly arranged chopped or stretch broken polymeric fibers, i.e. polymeric fibers having discontinuous lengths. Such fibers having discontinuous lengths are also known as staple fibers.

In another embodiment of the invention, the at least one second panel comprises at least one fabric layer, more preferably a plurality of fabric layers, said fabric layers comprising polymeric fibers. Preferably, the fabric layers have a woven structure. Preferably, the woven structure is chosen from the group consisting of a plain weave, a satin weave, a twill weave and a crow-foot weave. It was observed that good results were obtained when the fabric layers were free of binder or any other matrix material.

In a more preferred embodiment however, the at least one second panel is prepared by stacking and compressing two or more sheets comprising monolayers of polymeric fibers, preferably monolayers comprising a fabric made of polymeric fibers, more preferably monolayers containing unidirectionally aligned polymeric fibers. The monolayers may also contain a matrix material.

In a preferred embodiment of the invention, the at least one second panel contains a compressed stack of monolayers, each monolayer containing unidirectionally aligned polymeric fibers, preferably UHMWPE fibers, more preferably UHMWPE tapes, and optionally a matrix in at most 20 mass % of the total mass of the monolayer. The fiber direction in each monolayer is preferably rotated with respect to the fiber direction in an adjacent monolayer. The monolayers have a polymeric fiber mass of preferably between 25 and 150 gr/m$^2$, and the compressed stack of monolayers has an experimental density ($\rho_{EXP}$) of preferably at least 90.0%, more preferably of at least 95.0%, even more preferably of at least 98.0% of the theoretical maximum density. Such a panel can be obtained in accordance with EP 0 833 742, the disclosure of which is herein incorporated by reference. The experimental density of said panel can be measured by weighing said panel and measuring the volume of said panel using a Vernier caliper. The standard deviation according to this density measurement is 0.002-0.004 g/cm$^3$.

Preferably in a monolayer containing unidirectionally aligned polymeric fibers, at least 70 mass % of the total mass of fibers in said monolayer run along a common direction, more preferably at least 90 mass %, most preferably about 100 mass %. Preferably, the fibers' running direction in a monolayer is at an angle $\alpha$ to the fibers' running direction in an adjacent monolayer, whereby $\alpha$ is preferably between 5 and 90°, more preferably between 45 and 90°, even more preferably between 75 and 90°, most preferably about 90°.

A second panel suitable for the present invention can be manufactured according to well-known methods in the art. In a preferred embodiment, the second panels are rigid panels which are preferably obtained by compressing under temperature and pressure an assembly of polymeric fibers.

To compress an assembly of polymeric fibers, and more in particular a stack of two or more sheets comprising an assembly of polymeric fibers, said assembly or stack is generally placed in an open press or mould. The open mould may also have a female part and a male part. The assembly or stack may also be clamped to one part of the mould, generally to the female part. To obtain a flat panel, both the male and the female parts of the mould are planar; whereas to obtain a three dimensionally shaped panel, said male and female parts may contain curvatures or other shaped geometries in one or more directions. After placing the assembly or said stack of sheets in the mould, the mould is closed and pressure is applied on said assembly or stack. In order to compress the assembly or stack under temperature, the mould can be heated.

The temperature during compression is generally controlled through the mould temperature. The temperature during the compression step is preferably chosen below the melting temperature of the polymeric fibers as measured by DSC. If DSC cannot determine the melting temperature of a polymeric fiber then by said melting temperature is understood herein the temperature at which the polymeric fibers start to lose their mechanical properties, e.g. when the tensile strength of the fibers decreases with more than 5% of the tensile strength of the fiber as measured at room temperature. In case the assembly of polymeric fibers used to manufacture the second panel contains more than one type of polymeric fibers, by melting temperature is herein understood the melting temperature of the polymeric fibers having the lowest melting temperature.

Preferably the temperature during the compression step is at least 5° C., preferably at least 10° C. and even more at least 20° C. below the melting temperature of the polymeric fibers. For example, in the case of polyethylene and more particular of UHMWPE fibers, often having a melting temperature of about 155° C., a mould temperature of preferably below 145° C., more preferably below 135° C. will be chosen. The minimum temperature generally is chosen such that a reasonable speed of consolidation is obtained. In this respect 50° C. is a suitable lower temperature limit, preferably this lower limit is at least 75° C., more preferably at least 95° C., most preferably at least 115° C.

The pressure during consolidating preferably is at least 5 bars, more preferably at least 50 bars, even more preferably at least 100 bars and most preferably at least 250 bars. Good results were obtained when the assembly of polymeric fibers was compressed at pressures of at least 350 bars, preferably of at least 450 bars. In this way a better anti-ballistic performance is achieved. Optionally, the compression may be preceded by a lower pressure pre-compressing step. Pressure during this pre-compressing step may vary between 1 bar and 5 bars. After pre-compressing and before consolidating the mould may be opened and the occurrence of blisters may be verified, which may be removed by e.g. piercing with a sharp object. Other options to prevent blisters include degassing during molding or use of vacuum. The optimum time for consolidation generally ranges from 5 to 120 minutes and can be verified through routine experimentation.

Preferably, the at least one second panel forms the back face component of the inventive armor. By "back face component" is herein understood the component of inventive armor, positioned toward an object, thing or body which is to be protected by said armor from a ballistic impact. The back face component is positioned between the strike face component and said object, thing or body.

The inventive armor contains at least one rigid first panel and at least one second panel. The areal densities of the rigid first panel and of the second panel are dependant on the threat which the armor intents to mitigate. For example for armors designed to stop 20 mm Fragment Simulated Projectile (FSP), the at least one rigid first panel has an areal density of preferably at least 30 kg/m$^2$, more preferably at least 40 kg/m$^2$, most preferably at least 50 kg/m$^2$. For armors designed to stop 1.1 mm FSP, the at least one rigid first panel has an areal density of preferably at least 2 kg/m$^2$, more preferably at least 2.5 kg/m$^2$, most preferably at least 3 kg/m$^2$. If there are more than one rigid first panels used to manufacture the inventive armor, by areal density thereof is herein understood the total areal density of the rigid first panels, i.e. the sum of said areal densities.

In a preferred embodiment, the areal density of the at least one rigid first panel $AD_{1ST}$ is at least 10% of the total areal density of the inventive armor while preferably the areal density of the at least one second panel $AD_{2ND}$ is at most 90% of the total areal density of the inventive armor. If there are more than one second panels used to manufacture the inventive armor, by areal density thereof is herein understood the total areal density of the second panels, i.e. the sum of said areal densities.

In an even more preferred embodiment, $AD_{1ST}$ is at least 40% of the total areal density of the inventive armor while preferably the $AD_{2ND}$ is at most 60% of the total areal density of the inventive armor.

In an even more preferred embodiment, $AD_{1ST}$ is at least 60% of the total areal density of the inventive armor while preferably the $AD_{2ND}$ is at most 40% of the total areal density of the inventive armor.

In an even more preferred embodiment, $AD_{1ST}$ is between 10% and 95%, more preferably between 40% and 90%, most preferably between 60% and 85% of the total areal density of the inventive armor while preferably the $AD_{2ND}$ is the remaining percentage, i.e. up to 100%, of the total areal density of the inventive armor.

It was observed that for the above ranges of areal densities specific to the rigid first panel and to the second panel, the synergistic cooperation of said two panels was enhanced. It was observed that an armor containing said panels having areal densities within the above preferred ranges may defeat high velocity projectiles, i.e. projectiles having velocities of between 600 and 1000 m/s and even greater than 1100 m/s, without requiring excess thickness.

Preferably, the rigid first panel is attached to the second panel. Attachment means that can be used for this purpose include adhesive layers, bolts, stitches, staples and the like. In a preferred embodiment, the second panel is laminated onto the first rigid panel under pressure and temperature. The skilled person can routinely determine the lamination conditions.

The invention also relates to a method for retrofitting structures, e.g. vehicles or buildings, for improved resistance against ballistic impacts using the inventive armor. It was observed that the inventive armor provides the retrofitted structures with increased capability of absorbing and/or redirecting an impact from a projectile. Moreover, it was observed that the inventive armor is versatile and lightweight enough to be easily installed on a structure without the need of heavy or complicated machinery.

The retrofitting method of the invention comprises the steps of: (i) providing an armor comprising in front to back order at least one rigid first panel comprising inorganic fibers and at least one second panel comprising polymeric fibers, wherein the at least one rigid first panel has a flexural strength of at least 300 MPa and the at least one second panel has a flexural strength of at most 250 MPa; (ii) adapting said armor to be operably engaged with an interior and/or an exterior surface of the structure to be protected; and (iii) mounting said armor to cover at least partly said interior and/or exterior surface of said structure to be protected. In a preferred embodiment, the armor is mounted under an angle with respect to the surface of the structure. Such an arrangement provides an improved protection to said structure. The skilled person can routinely determine said angle.

Bolts, adhesives or other connectors as enumerated hereinabove may be used to facilitate the engagement of the inventive amour to the structure to be protected.

The invention also relates to a structure retrofitted with the inventive armor, said structure being preferably a vehicle or a building or building component, e.g. pillars, walls, windows and doors. Examples of vehicles suitable to be retrofitted with the inventive armor include automobiles, motorcycles, buses, trains, fuel transport vehicles, trucks, boats, satellites and space exploration vehicles, but also already armored vehicles, in particular light armored vehicles, e.g. STRYKER. It was observed that a retrofitted structure in accordance to the invention has a good survivability.

The invention further relates to structures and vehicles such as those mentioned hereinabove as well as other products containing the inventive armor. Examples of other products include helmets, breast plates, shields, and the like.

The invention will be explained in more detail below with the help of the following examples and comparative experiments.

Methods of Measuring

- Flexural strength of a panel is measured according to ASTM D790-07. To adapt for various thicknesses of the panel, measurements are performed according to paragraph 7.3 of ASTM D790-07 by adopting a loading and a support nose radius which are twice the thickness of the panel and a span-to-depth ratio of 32.
- Areal density (AD) was determined by measuring the weight of a sample of preferably 0.4 m×0.4 m with an error of 0.1 g.
- Intrinsic Viscosity (IV) for polyethylene is determined according to method PTC-179 (Hercules Inc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration.
- Side chains in a polyethylene or UHMWPE sample is determined by FTIR on a 2 mm thick compression molded film by quantifying the absorption at 1375 $cm^{-1}$ using a calibration curve based on NMR measurements (as in e.g. EP 0 269 151)
- Tensile properties, i.e. strength and modulus, of polymeric fibers were determined on multifilament yarns as specified in ASTM D885M, using a nominal gauge length of the fibre of 500 mm, a crosshead speed of 50%/min and Instron 2714 clamps, of type Fibre Grip D5618C. For calculation of the strength, the tensile forces measured are divided by the titre, as determined by weighing 10 meters of fibre; values in GPa for are calculated assuming the natural density of the polymer, e.g. for UHMWPE is 0.97 $g/cm^3$.
- The tensile properties of polymeric tapes: tensile strength and tensile modulus are defined and determined at 25° C. on tapes of a width of 2 mm as specified in ASTM D882, using a nominal gauge length of the tape of 440 mm, a crosshead speed of 50 mm/min.
- The tensile strength and modulus of inorganic fibers and in particular of glass fibers was measured according to ASTM D4018-81 at 22° C.
- The melting temperature (also referred to as melting point) of a polymer is determined by DSC on a power-compensation PerkinElmer DSC-7 instrument which is calibrated with indium and tin with a heating rate of 10° C./min. For calibration (two point temperature calibration) of the DSC-7 instrument about 5 mg of indium and about 5 mg of tin are used, both weighed in at least two decimal places. Indium is used for both temperature and heat flow calibration; tin is used for temperature calibration only.
- Tensile modulus of binders and matrix materials was measured according to ASTM D-638(84) at 25° C.
- The inorganic fiber volume content of a panel can be measured by optical means or according to ASTM D 2584 by thermally decomposing the matrix. The latter method is only possible for panels containing inorganic fibers which do not decompose at the decomposition temperature of the matrix. The optical method is thus preferred and uses a polished cross section of the panel. Micrographs are made with a high resolution optical microscope, or with a Scanning Electron Microscope (SEM). The detection of back scattered electrons provides good contrast if SEM is used which facilitates the interpretation of the micrograph. To improve contrast, staining or coloring techniques may also be used. The area $A_f$ of the surface covered by the inorganic fibers is determined from the micrograph and divided by the area $A_T$ of the total surface of the micrograph. The procedure is repeated at least five times for five different cross-sections at representative locations on the panel in order to compensate for statistical scatter. The inorganic fiber volume content $V_f$ is than computed with Formula 1:

$$V_f = \frac{A_f}{A_T} \qquad \text{Formula 1}$$

The remaining volume content is the binder volume content. The amount of fibers is than expressed in terms of vol % from the total volume of the panel $V_P$ which is computed according to Formula 2:

$$V_P = \frac{M_f}{\rho_f} + \frac{M_b}{\rho_b} \qquad \text{Formula 2}$$

where $M_f$ and $M_b$ are the masses of the inorganic fibers and of the binder, respectively, contained by the panel and $\rho_f$ and $\rho_b$ are the densities of the inorganic fibers and of the binder, respectively. Said masses and densities can be determined according to ASTM D 2584. Alternatively the volume of the panel may be measured directly with a Vernier caliper.

- Back face deformation of the armor was tested according to NIJ 0101.04 level IIIA using 1.1 mm FSP and 20 mm FSP on an internal shooting template.
- Ballistic performance was measured by subjecting the armor to shooting tests performed with standard (STANAG) 20 mm FSP and 1.1 mm FSP. The first shot was fired at a projectile speed ($V_{50}$) at which it is anticipated that 50% of the shots would be stopped. The actual bullet speed was measured at a short distance before impact. If a stop was obtained, the next shot was fired at an anticipated speed being 10% higher than the previous speed. If a perforation occurred, the next shot was fired at a speed 10% lower than the previous speed. The result for the experimentally obtained $V_{50}$ value was the average of the two highest stops and the two lowest perforations. The kinetic energy of the bullet at $V_{50}$ was divided by the total areal density of the armor to obtain a socalled $E_{abs}$ value. $E_{abs}$ reflects the stopping power of the armor relative to its weight/thickness thereof. The higher the $E_{abs}$ the better the armor is.

EXAMPLES AND COMPARATIVE EXPERIMENTS

Example 1

An armor was assembled from a single first rigid panel and a single second panel by stacking the two panels onto each other.

The rigid first panel sold under code FG 15 P 11 and having an areal density ($AD_{1ST}$) of about 50 kg/m$^2$ and lateral dimensions of 500 mm/500 mm was purchased from Verseidag, DE. The flexural strength of the rigid first panel was about 600 MPa. The panel was manufactured from S2-glass fibers and contained a phenolic binder. The volume percentage of fibers was 72 vol %, and the remaining volume percentage being occupied by the binder. The panel was manufactured by compressing in a mould under pressure and temperature a number of 47 layers of a fabric having a plain woven construction and containing the binder.

The tensile strength and modulus of the glass fibers were about 4.5 GPa and about 85 GPa, respectively. The diameter of the glass fibers was about 10 μm.

A panel commonly known as HB26 and sold by DSM Dyneema, NL, was used as the second panel. The HB26 panel contained a number of 80 monolayers of unidirectionally oriented UHMWPE fibers known as SK76 and a polyurethane matrix. The areal density ($AD_{2ND}$) of the second panel was 26 kg/m$^2$. The size of the second panel was 500 mm/500 mm. The amount of fibers in the second panel was about 80 mass %, the remaining 20 mass % being the matrix. The flexural strength of the panel was 50 MPa.

The armor was shot at with a 20 mm FSP and a 1.1 mm FSP. The results are presented in the Table.

Example 2

Example 1 was repeated with the difference that the areal density of the rigid first panel was 31 Kg/m$^2$ and the areal density of the second panel was 31 Kg/m$^2$.

Example 3

Example 1 was repeated with the difference that the areal density of the rigid first panel was 62 Kg/m$^2$ and the areal density of the second panel was 16 Kg/m$^2$.

Example 4

An armor was assembled from a single first rigid panel and a single second panel by stacking the two panels onto each other, wherein the rigid first panel contained carbon fibers.

The rigid first panel was manufactured by resin transfer molding and contained a number of 45 cross-plied (0-90°) monolayers of unidirectionally aligned carbon fibers and an epoxy resin as binder.

The carbon fibers were of T700 SC 60 E type (from R&G, GmbH, DE) and were formed into a yarn having a titer of 800 tex and consisting of 12.000 filaments. The tensile strength of the carbon fibers was 4.9 GPa and their modulus 230 GPa.

The binder was an epoxy resin (RIM L 235 from Hexion) hardened by using a hardener of type H237 (from Hexion). The ratio epoxy resin/hardener was 100 parts/34 parts.

The filaments forming the carbon fiber yarn were spread and wound onto a rectangular plate (90 cm/90 cm) to form cross-plied monolayers of unidirectionally aligned carbon filaments. After forming 45 monolayers, a panel was made by resin transfer molding by injecting the mixture of epoxy resin/hardener with an injection press at 55 mbar. The panel was cured under a pressure of 504 mbar at room temperature and post cured for 5 h at 80° C.

The obtained rigid first panel had a flexural strength of 740 MPa. The vol % of carbon fibers in the panel was 65 and the vol % of epoxy resin 35%. The areal density of the rigid first panel was 6.88 Kg/m$^2$.

A second panel as in Example 1 was used, having an areal density of 3.04 Kg/m$^2$.

The armor was shot at with a 1.1 mm FSP. The results are presented in the Table.

Comparative Experiment 1

Example 1 was repeated with the difference that the areal density of the rigid first panel was 79 Kg/m$^2$ and no second panel was used.

Comparative Experiment 2

Example 1 was repeated with the difference that the areal density of the second panel was 46 Kg/m$^2$ and no rigid first panel was used.

Comparative Experiment 3

Example 4 was repeated with the difference that the areal density of the rigid first panel was 12.4 Kg/m$^2$ and no second panel was used.

Using the result of Table it can be shown that the inventive armors have a ballistic performance above a theoretical performance of an armor containing inorganic and organic fiber which is computed using the normal rule of mixtures. Therefore, the rigid first panel and the second panel synergistically collaborate to enhance the efficiency and ballistic performance of the armor of the invention.

TABLE

| | Threat | $AD_{1ST}$ (Kg/m$^2$) | $AD_{2ND}$ (Kg/m$^2$) | $V_{50}$ (m/s) | $E_{abs}$ Experimental (J/kg/m$^2$) |
|---|---|---|---|---|---|
| Example 1 | 20 mm FSP | 50 | 26 | 1425 | 758 |
| Example 2 | 20 mm FSP | 31 | 31 | 1220 | 644 |
| Example 3 | 20 mm FSP | 62 | 16 | 1400 | 671 |
| Example 1 | 1.1 mm FSP | 3.5 | 3.5 | 656 | 28.5 |
| Example 2 | 1.1 mm FSP | 4.9 | 2.1 | 725 | 28.1 |
| Example 3 | 1.1 mm FSP | 7.4 | 1.4 | 675 | 22.5 |
| Example 4 | 1.1 mm FSP | 6.9 | 3 | 722 | 28.9 |
| C. Exp. 1 | 20 mm FSP | 79 | — | 1050 | 374 |
| C. Exp. 2 | 20 mm FSP | — | 46 | 1050 | 640 |
| C. Exp. 1 | 1.1 mm FSP | 13 | — | 600 | 15.3 |
| C. Exp. 2 | 1.1 mm FSP | — | 6.1 | 600 | 32.5 |
| C. Exp. 3 | 1.1 mm FSP | 12.4 | — | 530 | 12.6 |

The invention claimed is:

1. An armor having a total areal density AD and a total energy absorption value Eabs, wherein the armor comprises in front to back order:

at least one rigid first panel comprising inorganic fibers having a first areal density $AD_{1ST}$ and an energy absorption value $Eabs_{1ST}$, and at least one second panel comprising polymeric fibers having a second areal density $AD_{2ND}$ and an energy absorption value $Eabs_{2ND}$, wherein the areal density $AD_{1ST}$ of the at least one rigid first panel is at least 40% of the total areal density AD of the armor, and the areal density $AD_{2ND}$ of the at least one second panel is at most 60% of the total areal density AD of the armor, and wherein the total energy absorption value Eabs exhibited by the armor is larger than a combination of the energy absorption value $Eabs_{1ST}$ of the at least one rigid first panel and the energy absorption value $Eabs_{2ND}$ of the at least one second panel.

2. The armor of claim 1, wherein the at least one rigid first panel is an outermost front panel of the armor.

3. The armor of claim 1, wherein the inorganic fibers of the at least one rigid first panel are selected from the group consisting of glass fibers, ceramic fibers, carbon fibers, basalt fibers, glass-basalt fibers and combinations thereof.

4. The armor of claim 1, wherein the at least one rigid first panel comprises a binder having a tensile modulus of at least 0.5 GPa.

5. The armor of claim 1, wherein the inorganic fibers of the at least one rigid first panel form an assembly of woven or non-woven inorganic fibers.

6. The armor of claim 1, wherein the inorganic fibers are carbon fibers.

7. The armor of claim 1, wherein the inorganic fibers are glass fibers.

8. The armor of claim 1, wherein the inorganic fibers are present in an amount of at least 50 vol % based on total volume of the at least one rigid first panel.

9. The armor of claim 1, wherein the polymeric fibers of the at least one second panel are present in an amount of at least 50 mass % based on total mass of the at least one second panel.

10. The armor of claim 1, wherein the polymeric fibers of the at least one second panel are polyolefin fibers.

11. The armor of claim 1, wherein the at least one second panel comprises a compressed stack of monolayers, wherein each monolayer of the compressed stack comprises unidirectionally aligned polymeric fibers, and wherein fiber direction in each monolayer of the compressed stack is rotated with respect to fiber direction in an adjacent monolayer of the compressed stack, and wherein the compressed stack of monolayers has an experimental density (ρEXP) of at least 90.0%.

12. The armor of claim 1, wherein the inorganic fibers of the at least one rigid first panel are glass fibers, and the polymeric fibers of the at least one second panel are ultra high molecular weight polyethylene (UHMWPE) fibers with an intrinsic viscosity of at least 4 dl/g.

13. The armor of claim 1, the at least one rigid first panel has a flexural strength of at least 300 MPa, and the at least one second panel has a flexural strength of at most 250 MPa.

14. The armor of claim 13, wherein the at least one rigid first panel has a flexural strength of between 570 and 750 MPa.

15. The armor of claim 7, wherein the glass fibers are S2-glass fibers.

16. The armor of claim 10, wherein the polyolefin fibers are polyethylene fibers.

17. A method for retrofitting a structure to provide antiballistic protection thereof comprising the steps of:

(i) providing an armor according to claim 1;

(ii) adapting the armor for operative engagement with an interior and/or an exterior surface of the structure; and (iii) mounting the armor to cover at least partly the interior and/or exterior surface of the structure to provide antiballistic protection thereto.

18. The method of claim 17, wherein the structure is a vehicle or a building.

19. A structure comprising the armor of claim 1, wherein the structure is selected from the group consisting of automobiles, motorcycles, buses, trains, fuel transport vehicles, trucks, boats, satellites and space exploration vehicles, building or building component, pillars, walls, windows and doors.

* * * * *